US007540253B2

(12) United States Patent
Mizutani

(10) Patent No.: US 7,540,253 B2
(45) Date of Patent: Jun. 2, 2009

(54) BOAT STEERING SYSTEM

(75) Inventor: Makoto Mizutani, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 110 days.

(21) Appl. No.: 11/859,654

(22) Filed: Sep. 21, 2007

(65) Prior Publication Data

US 2008/0115713 A1 May 22, 2008

(30) Foreign Application Priority Data

Nov. 17, 2006 (JP) ..... 2006-312172

(51) Int. Cl.
*B63H 25/00* (2006.01)
*B63H 25/06* (2006.01)

(52) U.S. Cl. ..... 114/144 RE; 114/162

(58) Field of Classification Search ..... 114/144 RE
See application file for complete search history.

(56) References Cited

U.S. PATENT DOCUMENTS 6,843,195 B2 * 1/2005 Watabe et al. ..... 114/144 E

FOREIGN PATENT DOCUMENTS

JP 04-038297 2/1992
JP 2959044 7/1999
JP 2005-254848 9/2005
JP 2006-069408 3/2006

OTHER PUBLICATIONS

U.S. Appl. No. 11/859,544, filed Sep. 21, 2007, entitled Watercraft Steering System.
U.S. Appl. No. 11/859,533, filed Sep. 21, 2007, entitled Watercraft Steering System.
U.S. Appl. No. 11/781,785, filed Jul. 23, 2007, entitled Steering System for Outboard Motor.
U.S. Appl. No. 11/853,731, filed Sep. 11, 2007, entitled Boat Steering System.

* cited by examiner

*Primary Examiner*—Jesus D Sotelo
(74) *Attorney, Agent, or Firm*—Knobbe, Martens, Olson & Bear, LLP

(57) ABSTRACT

A boat steering system provides an operator with excellent efficiency and an excellent operation feel during direction guide member deflection by considering and making adjustments based on a running status of the boat. An ECU controls a direction guide member deflection angle limit. The ECU includes and/or communicates with detectors and the like for detecting one or more of an operation status corresponding to a steering wheel operation, a running status of the boat, recognizing a status of an outboard motor, and detecting a status of an electric motor that rotates an outboard motor. The ECU also controls a direction guide member deflection angle limit based on one or more of the detection values.

16 Claims, 8 Drawing Sheets

[FIG. 1]
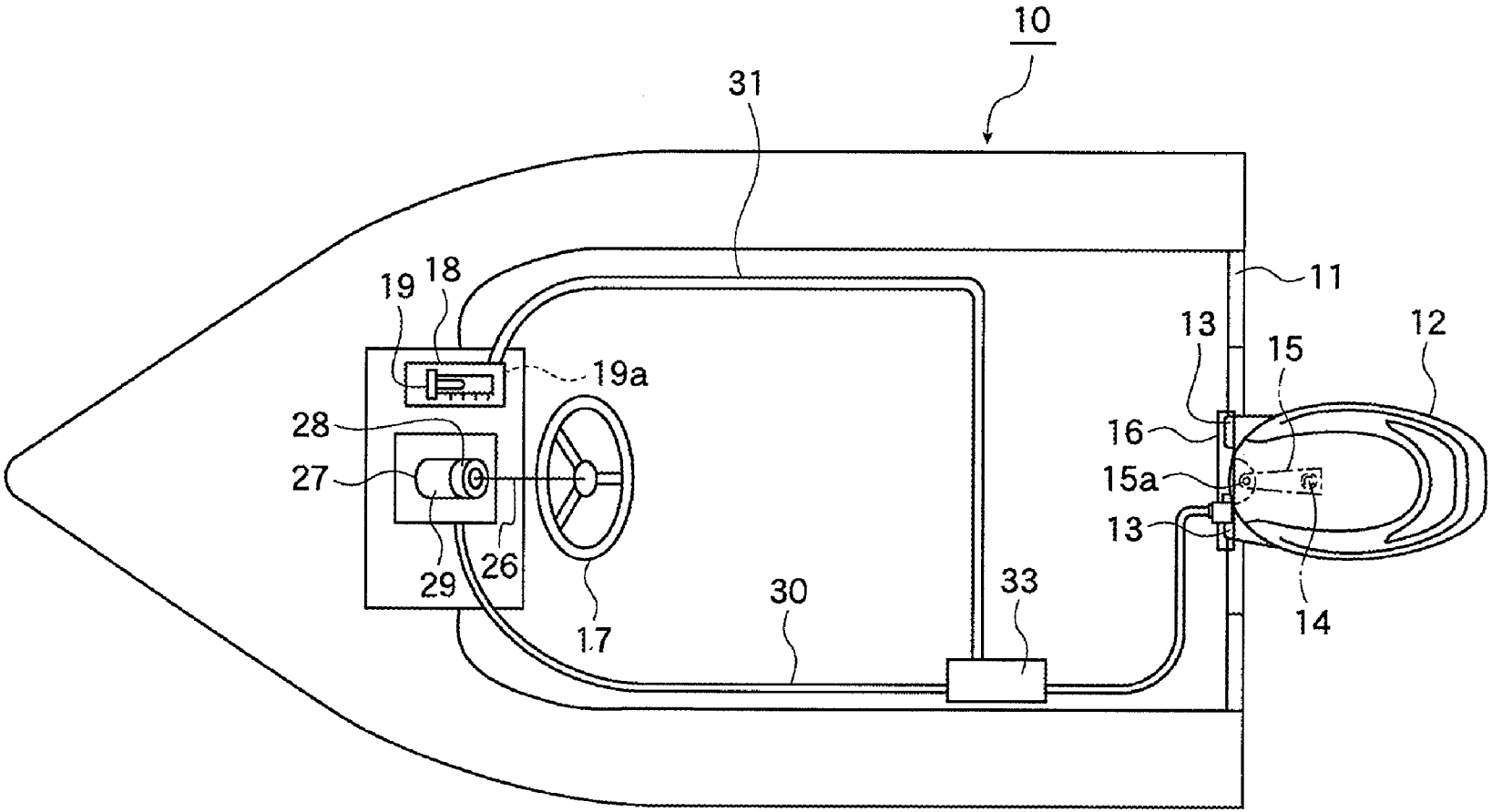

[FIG. 2]
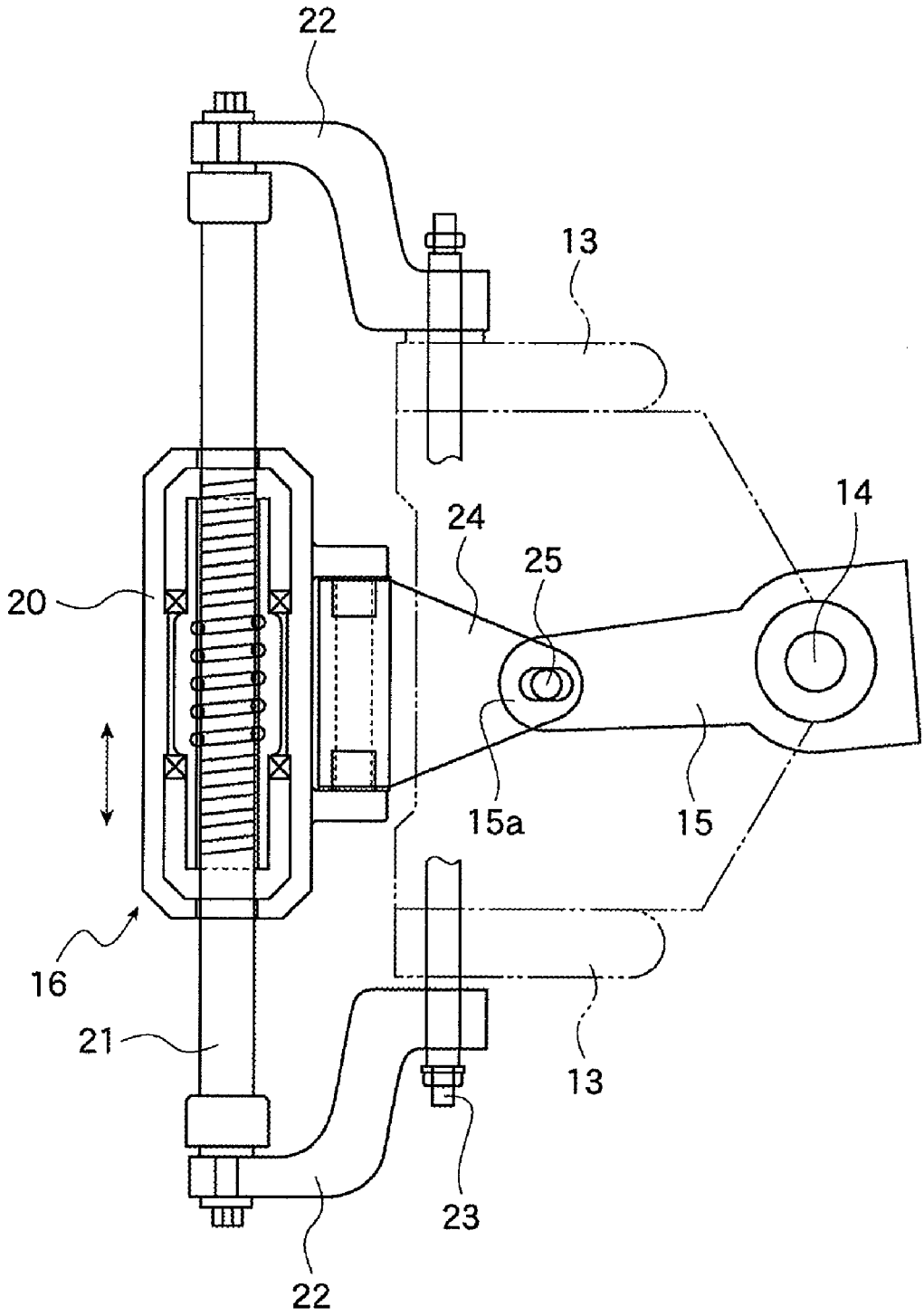

[FIG. 3]
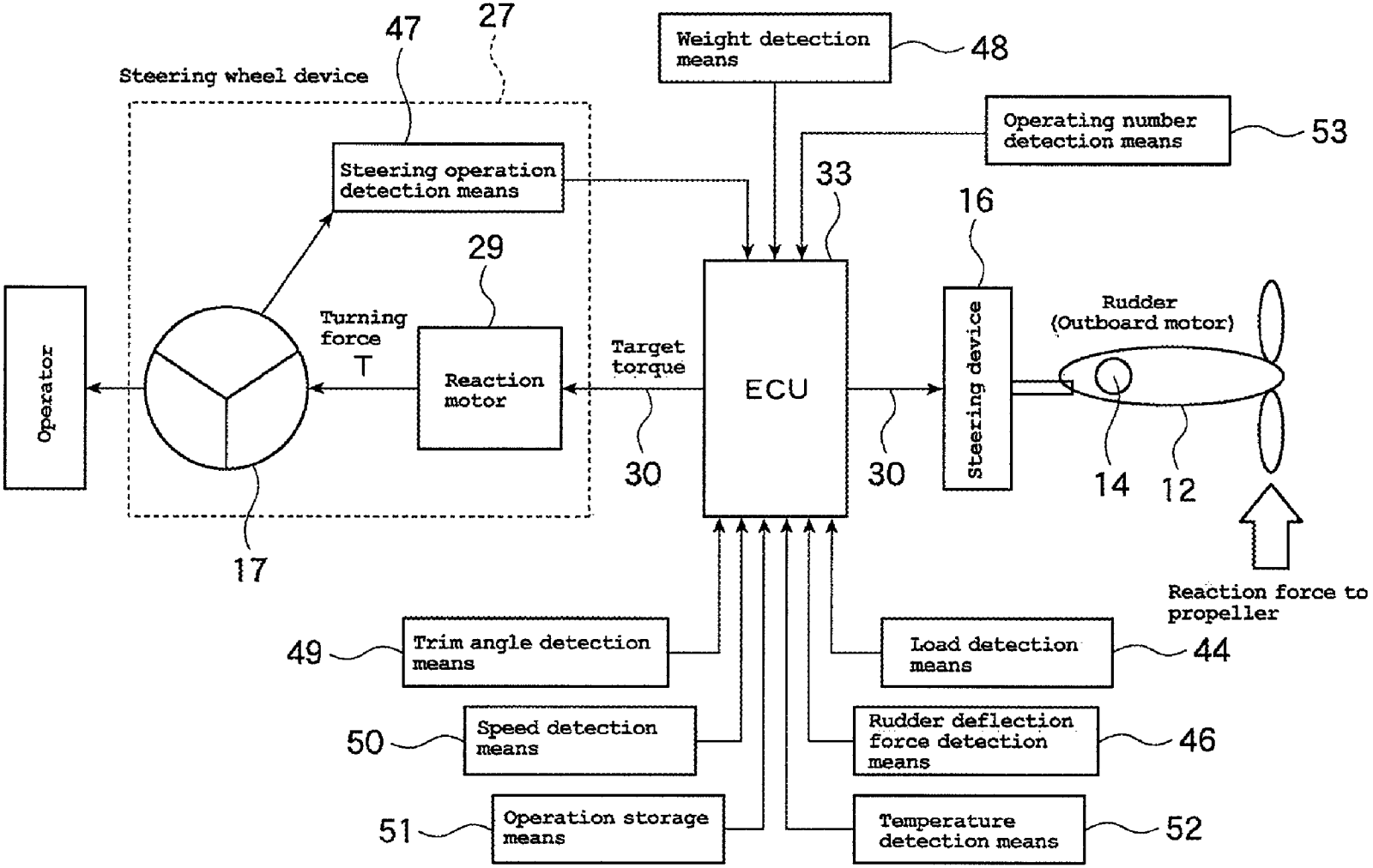

[FIG. 4]
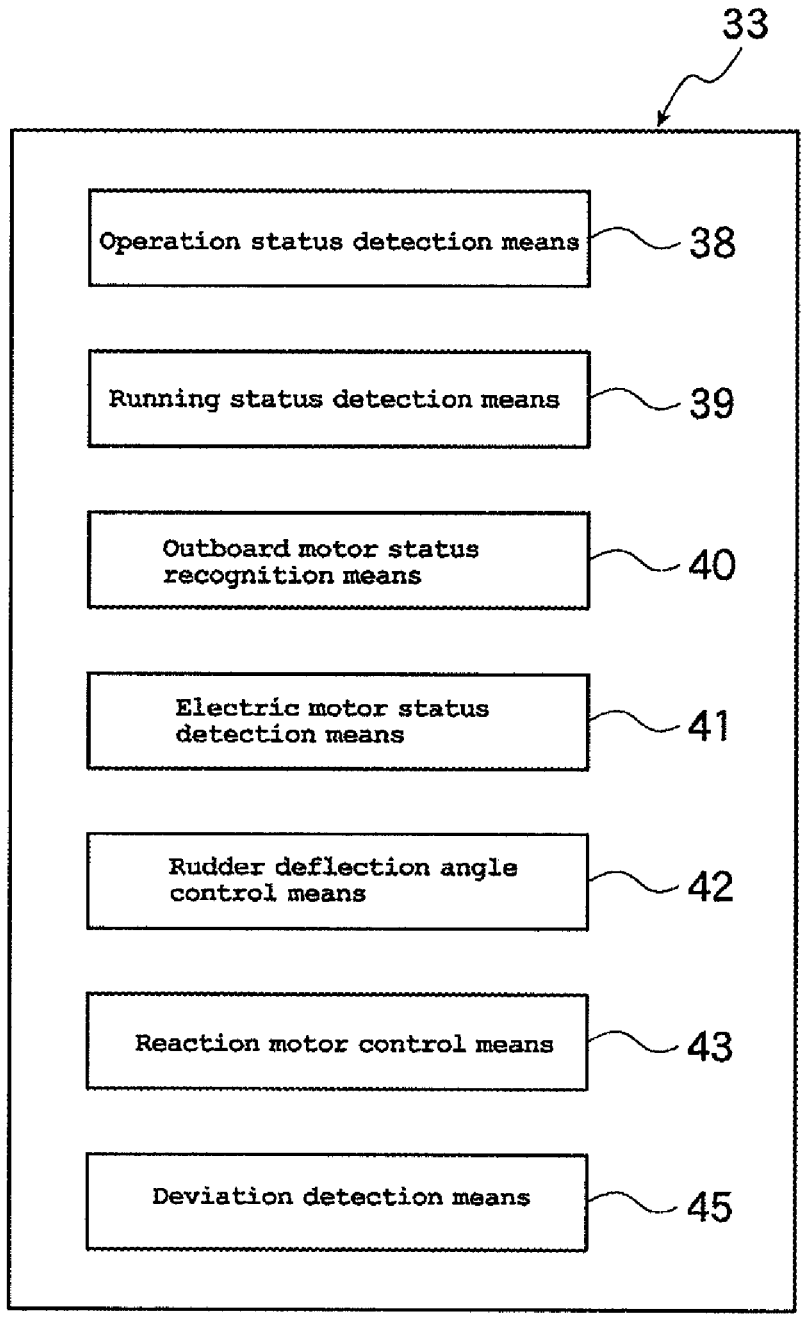

[FIG. 5]
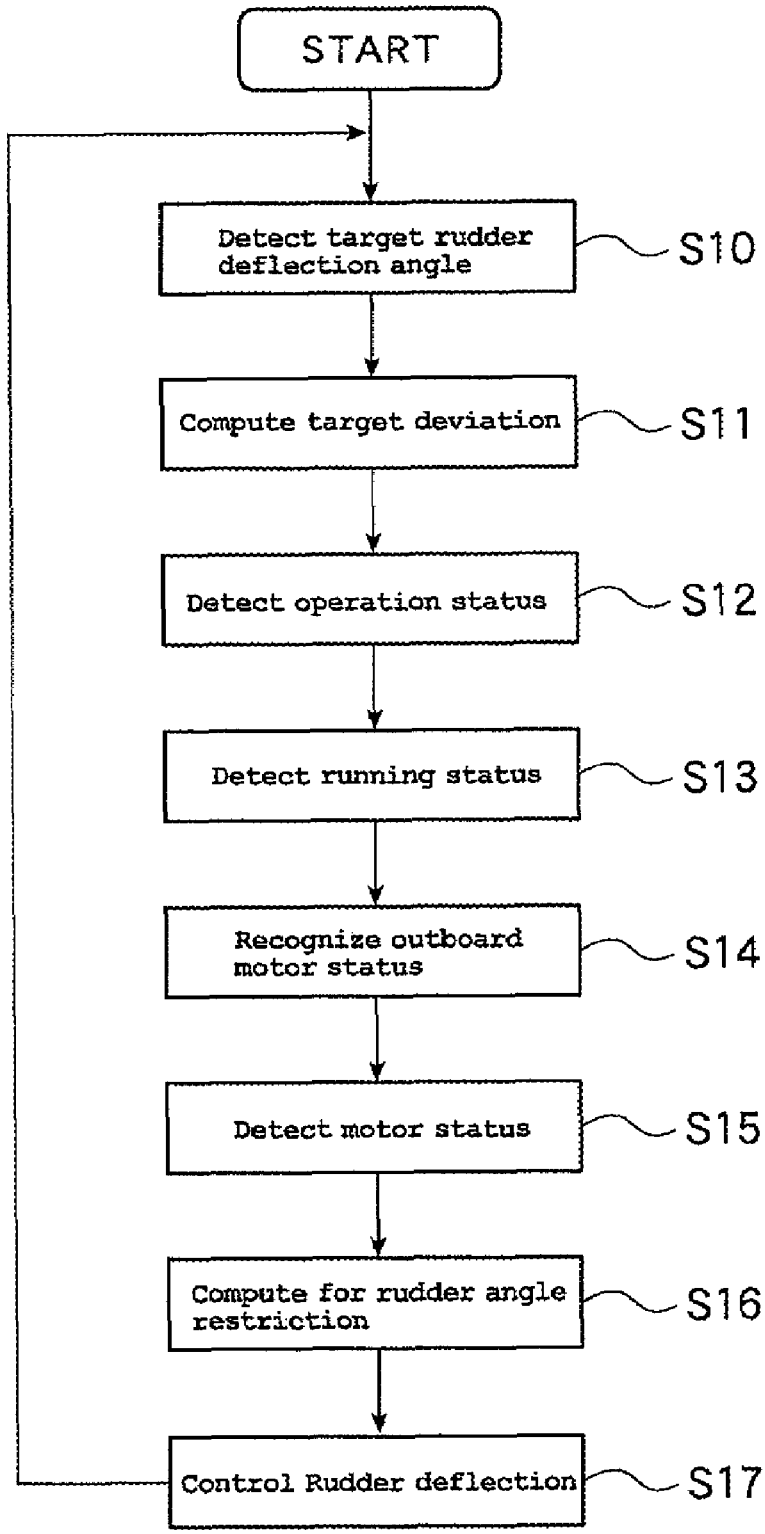

[FIG. 6]
(a)
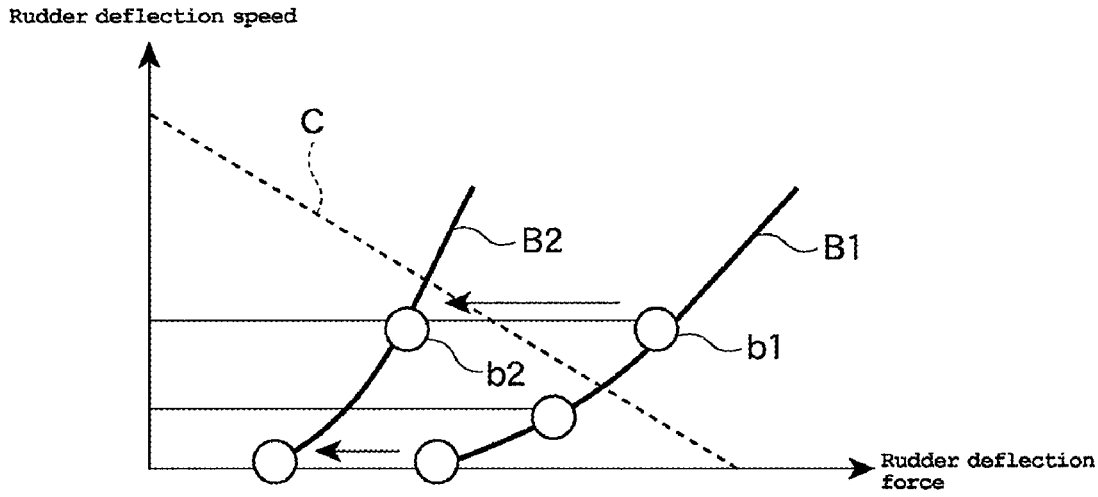
(b)
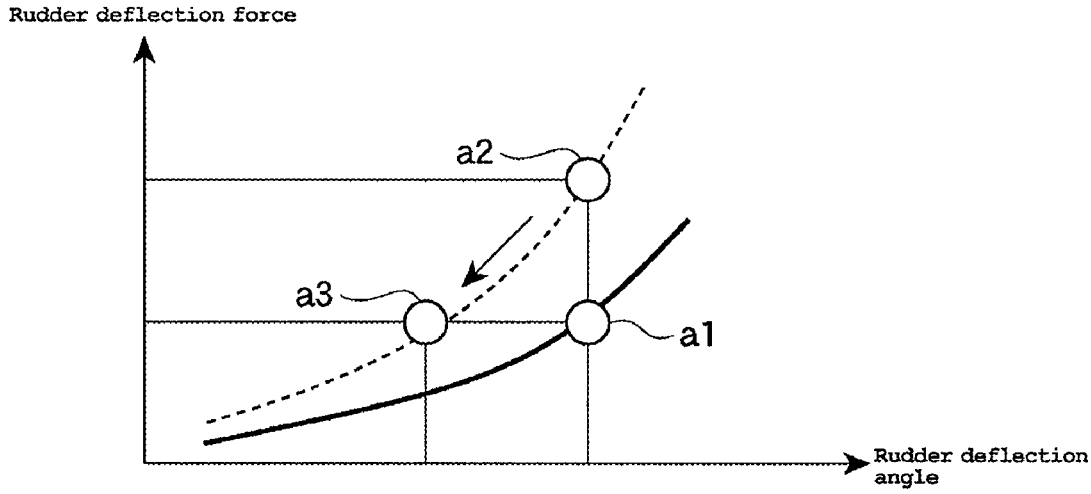

[FIG. 7]
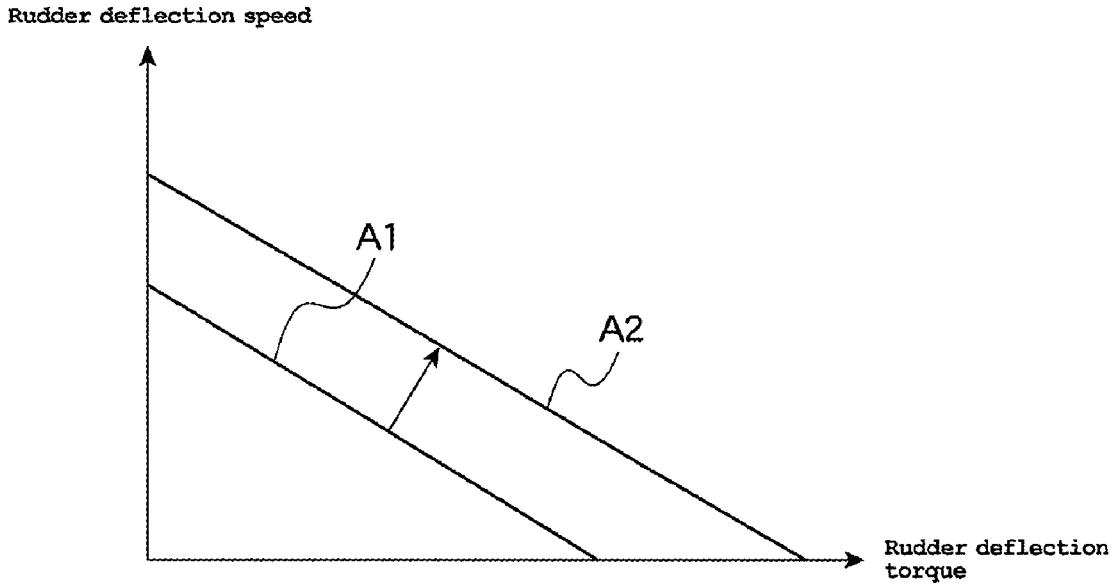

[FIG. 8]
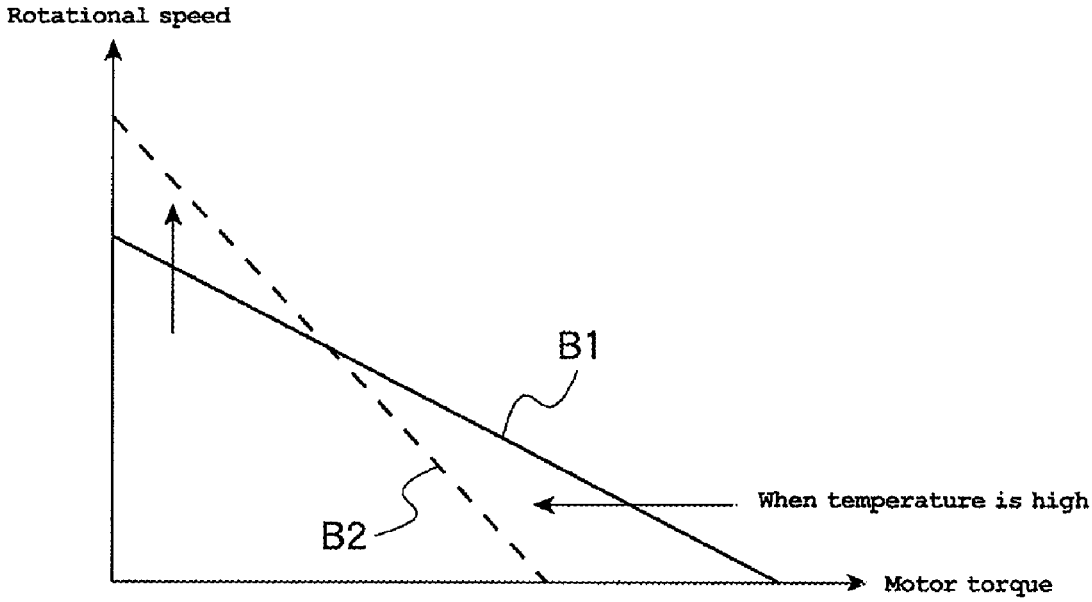

BOAT STEERING SYSTEM

CROSS-REFERENCE TO RELATED APPLICATIONS

The present application is based on and claims priority under 35 U.S.C. § 119 to Japanese Patent Application Serial No. 2006-312172, filed on Nov. 17, 2006, the entire contents of which are expressly incorporated by reference herein.

BACKGROUND OF THE INVENTION

1. Field of the Invention

The present invention relates to a boat having a steering system and, more particularly relates to a steering system having an electric actuator.

2. Description of the Related Art

In conventional boat, the boat is steered in response to operation of the steering wheel. Japanese Patent Document No. JP-A-2005-254848 discloses an electric actuator that is actuated as an operator operates the steering wheel. An external force to the boat is detected during such steering, and a reaction torque is applied to the steering wheel based on the detected external force. Accordingly, the operator can feel the external force to the boat due to, for example, a water current, directly through the steering wheel, and thus can recognize the movement of the boat corresponding to such external force so as to react quickly.

When such a boat is under no external force, an operation feel of the steering wheel can be lighter. Unfortunately, when larger output is required for direction guide member deflection (high direction guide member deflection torque), and when the steering wheel is operated faster, output from the steering motor (electric actuator) becomes less responsive, resulting in a poor operation feel.

It should be noted that direction guide member deflection torque characteristics sufficient to cause direction guide member deflection may change depending on a number of conditions. For example, FIG. 7 shows a change from direction guide member deflection force characteristic line A1 to direction guide member deflection force characteristic line A2, depending on conditions such as the characteristics of the boat, a direction guide member angle, an operation speed, or the like. In such case, if a limit to the direction guide member deflection angle never changes, a direction guide member deflection force required when the direction guide member is returned after being deflected to a maximum position may exceed the motor's ability, resulting in impaired responsiveness and a poorer operation feel.

Further, as shown in FIG. 8, some motor characteristics depend on the surroundings such as temperature. For example, when the temperature becomes high the motor characteristics may change from the state shown by motor characteristic line B1 (solid line in the figure) to the state shown by motor characteristic line B2 (broken line in the figure). Since the motor characteristics at high temperatures provide lower torque, a direction guide member deflection force required may not be obtained during light temperature conditions, resulting in impaired responsiveness and a poorer operation feel.

SUMMARY

Accordingly, there is a need in the art for a boat steering system that provides an operator with excellent efficiency and excellent operation feel during direction guide member deflection, while considering a running status of the boat.

In accordance with a preferred embodiment, the present invention provides a boat comprising a hull and a propulsion unit at a stern of the hull. A steering device comprises a deflectable direction guide member and an electric actuator for deflecting the direction guide member so as to steer the boat. A steering wheel is operable by an operator. The steering wheel is adapted to provide an actuation signal corresponding to the amount of a steering wheel operation. A controller is adapted to receive the steering wheel actuation signal and to direct the electric actuator to deflect the direction guide member. The controller is configured to obtain or receive detection data concerning at least one of an operation status corresponding to the steering wheel operation, a running status of the boat, a status of the propulsion unit, and a status of the electric actuator. The controller calculates a direction guide member deflection angle limit based on at least one of the detection data. The direction guide member deflection angle limit is calculated so that direction guide member deflection remains within a range in which the electric actuator maintains a threshold performance level so that steering performance remains advantageous.

Another embodiment comprises an operation status detector that detects at least one of a direction guide member deflection force required for direction guide member deflection, a load to the direction guide member, a direction in which the direction guide member is deflected corresponding to a direction in which the steering wheel is operated and/or the steering wheel operation, and a deviation of a detected actual direction guide member deflection angle from a target direction guide member deflection angle corresponding to the steering wheel operation.

A further embodiment comprises a running status detector that detects at least one of a position of a waterline and a weight of the boat, a trim angle of the boat, and at least one of a speed, an acceleration, a deceleration and a propulsive force of the boat, and an output of the propulsion unit.

A yet further embodiment additionally comprises an operation storage device for storing therein any one of pieces of information on the installation number of the boat propulsion unit, an installation position of the boat propulsion unit relative to the boat, a rotational direction of a propeller of the boat propulsion unit, a propeller shape, a trim tab angle and a trim tab shape.

A still further embodiment comprises an electric actuator status detector that includes a temperature detector for detecting a temperature of the electric actuator. In one embodiment, the electric actuator status detector includes an operating number detector for detecting the number of electric actuators in operation.

Yet a further embodiment comprises a running status detector that detects at least one of a position of a waterline and a weight of the boat, a trim angle of the boat, and at least one of a speed, an acceleration, a deceleration and a propulsive force of the boat, and an output of the propulsion unit.

Another embodiment additionally comprises an operation storage device for storing information on one or more of the installation number of the boat propulsion unit, an installation position of the boat propulsion unit relative to the boat, a rotational direction of a propeller of the boat propulsion unit, a propeller shape, a trim tab angle and a trim tab shape.

A still further embodiment additionally comprises a reaction motor for applying a reaction force to the steering wheel, and a reaction motor controller, wherein the reaction motor controller is adapted to increase a reaction force of the reaction motor as the direction guide member approaches the direction guide member deflection angle limit.

In another embodiment, the propulsion unit comprises an outboard motor, and the direction guide member is part of the outboard motor.

In accordance with another embodiment, a method is provided for steering a boat having a propulsion unit supported by a hull, a direction guide member, and an electric actuator adapted to deflect the direction guide member to effect steering. The method comprises providing a controller adapted to control deflection of the direction guide member, providing a steering wheel adapted to generate a signal corresponding to steering wheel operation, communicating the steering wheel signal to the controller, communicating to the controller detection data concerning at least one of an operation status corresponding to steering wheel operation, a running status of the boat, a status of the propulsion unit, and a status of the electric actuator, and calculating a direction guide member deflection angle limit based on at least one of the detection data communicated to the controller. The direction guide member deflection angle limit is calculated so that the electric actuator will be capable of deflecting the direction guide member up to the direction guide member deflection angle limit while maintaining a desired range of performance.

BRIEF DESCRIPTION OF THE DRAWINGS

FIG. 1 is a plan view of a boat in accordance with one embodiment.

FIG. 2 is an enlarged plan view of a steering device of the boat in accordance with the embodiment of FIG. 1.

FIG. 3 is a block diagram showing interactions of some systems and detectors in accordance with an embodiment.

FIG. 4 is a block diagram of aspects of an ECU in accordance with one embodiment.

FIG. 5 is a flowchart of a reaction control process in accordance with an embodiment.

FIG. 6 are graphs illustrating the operation in accordance with the embodiment of the present invention, in which FIG. 6(*a*) illustrates the relationship between direction guide member deflection speeds and direction guide member deflection forces; and FIG. 6(*b*) illustrates the relationship between direction guide member deflection angles and direction guide member deflection forces.

FIG. 7 is a graph of deflection force characteristics, illustrating a relationship between direction guide member deflection torques and direction guide member deflection speeds.

FIG. 8 is a graph of motor characteristics, illustrating a relationship between torques generated by an electric motor and rotational speeds at different temperatures.

DETAILED DESCRIPTION OF PREFERRED EMBODIMENTS

With initial reference to FIGS. 1 to 8, an embodiment of a boat has a hull 10 including a transom 11. A "boat propulsion unit" is mounted to the transom 11 of the hull 10. In the illustrated embodiment, the propulsion unit is an outboard motor 12 mounted to the transom 11 via clamp brackets 13. The outboard motor 12 preferably is pivotable about a swivel shaft (steering pivot shaft) 14 that extends in a generally vertical direction. The outboard motor 12 serves as a direction guide member as it pivots, and thus the direction in which the boat is driven is changed as the outboard motor 12 pivots. It is to be understood that other types of propulsion units, such as inboard motors, stem devices, or the like, may also employ principles disclosed herein.

A steering bracket 15 is fixed at the upper end of the swivel shaft 14. The steering bracket 15 is coupled at its front end 15*a* to a steering device 16. The steering device 16 is driven by operating a steering wheel 17 in an operator's section of the hull 10.

In the embodiment shown in FIG. 2, the steering device 16 includes a DD (direct drive) electric motor 20 that is attached to a threaded rod 21 extending in a width direction of the boat. The motor 20 is movable in the width direction of the boat along the threaded rod 21.

The illustrated threaded rod 21 is supported at its ends by a pair of left and right supports 22. The supports 22 are supported by a tilt shaft 23. The illustrated electric motor 20 has a coupling bracket 24 extending rearward. The coupling bracket 24 and steering bracket 15 are coupled with each other via a coupling pin 25.

As a result, as the electric motor 20 is actuated to move in the width direction of the boat relative to the threaded rod 21, the outboard motor 12 will pivot about the swivel shaft 14 via the coupling bracket 24 and the steering bracket 15. As such, the motor actuates steering of boat by rotating the motor 12.

With reference again to FIG. 1, the steering wheel 17 preferably is fixed to a steering wheel shaft 26. At the proximal end of the steering shaft 26, there is provided a steering wheel control unit 27. The steering wheel control unit 27 includes a steering wheel operation angle sensor 28 for detecting an operation angle of the steering wheel 17, and a reaction motor 29 for applying a desired reaction force to the steering wheel 17 during operation of the steering wheel 17 by the operator.

The steering wheel control unit 27 is connected to an electronic control unit (ECU) 33 via a signal cable 30. The control unit 33 is connected to the electric motor 20 of the steering device 16. The control unit 33 receives a signal from the steering wheel operation angle sensor 28, controls the electric motor 20, and controls the reaction motor 29.

As shown in FIG. 4, the control unit 33 preferably includes operation status detection means 38 for detecting an operation status corresponding to an operator's steering wheel operation, running status detection means 39 for detecting a running status of the boat, outboard motor status recognition means 40 for recognizing a status of the outboard motor 12, such as its installation number, and electric motor status detection means 41 for detecting a status of the electric motor 20.

The control unit 33 also preferably includes direction guide member deflection angle control means 42 for reducing a direction guide member deflection angle limit when it determines that a load to the electric motor 20 during direction guide member deflection will increase beyond a threshold value if the direction guide member deflection angle is greater than the calculated limit. This reduced direction guide member deflection angle limit preferably considers detection values from the operation status detection means 38. The control unit 33 also preferably includes reaction motor control means 43 that increases a reaction force applied by the reaction motor 29 as the direction guide member approaches the direction guide member deflection angle limit.

The operation status detection means 38 preferably includes direction guide member deflection force detection means 46 for detecting a direction guide member deflection force required for direction guide member deflection, load detection means 44 for detecting a load to the direction guide member, such as water pressure, and steering operation detection means 47 preferably for detecting a direction in which the direction guide member is deflected, corresponding to a direction in which the steering wheel 17 is operated and/or a steering wheel operation, as shown in FIG. 3, and deviation detection means 45 for detecting a deviation of a detected actual direction guide member deflection angle from a target direction guide member deflection angle corresponding to the steering wheel operation, as shown in FIG. 4. The steering wheel operation angle sensor 28 provided in the steering operation detection means 47 detects a steering wheel operation angle.

The numerous "means" introduced and discussed herein comprise detectors configured to detect the associated characteristics and generate an electronic signal that is communicated to the control unit 33 and/or to another detector. Such detectors may have any suitable structure, may employ one or more sensors working alone or in concert, may include stored data, may conduct and store calculations based upon sensor inputs and/or stored data, and the like.

To the running status detection means 39 there preferably are connected weight detection means 48 for detecting the position of a waterline and the weight of the boat, trim angle detection means 49 for detecting a trim angle of the boat, speed detection means 50 for detecting a speed, an acceleration, a deceleration and a propulsive force of the boat, and an output of the outboard motor 12, and PTT operation status detection means (not shown) for detecting a PTT operation status, as shown in FIG. 3.

Further, to the outboard motor status recognition means 40 there preferably is connected operation storage means 51 for storing therein information on the installation number of the outboard motor 12, the installation position of the outboard motor 12 relative to the boat, a rotational direction of a propeller of the outboard motor 12, a propeller size, a propeller shape, a trim tab angle, a trim tab shape, and the like. The operation storage means 51 can be included in the ECU 33.

Furthermore, the electric motor status detection means 41 preferably includes temperature detection means 52 for detecting a temperature of the electric motor 20, and operating number detection means 53 for detecting the number of electric motors 20 in operation.

It is to be understood that the above-described list of means or detectors does not necessarily comprise an exhaustive list of all the detectors that can be used in embodiments of the inventions and neither does it represent a minimum list of detectors. Rather, it presents an example embodiment. It is contemplated that other embodiments may employ more or less detectors (means) and that such means may be somewhat different in configuration and in their electronic interconnections than as specifically described in this example embodiment.

With reference to FIG. 5, the operation of an embodiment will be described below.

As the operator first turns the steering wheel 17 in any direction by any angle, a signal will be transmitted from the steering wheel operation angle sensor 28 in the steering operation detection means 47 to the ECU 33. Then, in step S10 of FIG. 5, a target direction guide member deflection angle is detected, and in step S11, a target deviation is computed.

In step S12, the operation status detection means 38 detects an operation status. As used herein, the term "operation status" refers to at least a direction guide member deflection force required for deflecting the outboard motor 12, a load to the direction guide member (outboard motor 12 in a preferred embodiment), a direction in which the steering wheel 17 is operated, a direction in which the direction guide member (outboard motor 12) is deflected, a deviation of a detected actual direction guide member deflection angle from a target direction guide member deflection angle corresponding to a steering wheel operation, and the like.

The direction guide member deflection force is detected by the direction guide member deflection force detection means 46. The load to the direction guide member is detected by the load detection means 44. The direction in which the steering wheel 17 is operated and the direction in which the direction guide member is deflected are detected by the steering operation detection means 47. The deviation of a detected actual direction guide member deflection angle from a target direction guide member deflection angle corresponding to the steering wheel operation is detected by the deviation detection means 45. Detection signals from those means preferably are transmitted to the operation status detection means 38 to thereby detect the operation status.

In step S13, the running status detection means 39 detects a running status. As used herein, the term "running status" refers to the position of a waterline, the weight, a trim angle, a speed, an acceleration, a deceleration and a propulsive force of the boat, an output of the outboard motor 12, and such aspects concerning operation of the hull 11 and motor 12 to the surrounding body of water.

The position of a waterline and the weight of the boat are detected by the weight detection means 48. The trim angle of the boat is detected by the trim angle detection means 49. The speed, the acceleration, the deceleration and the propulsive force of the boat, and the output of the outboard motor 12 preferably are detected by the speed detection means 50. Detection signals from those means preferably are transmitted to the running status detection means 39 to thereby detect and/or calculate the running status.

In step S14 the outboard motor status recognition means 40 recognizes a status of the outboard motor 12. As used herein, the term "the status of the outboard motor 12" refers to the installation number of the outboard motor 12, the installation position of the outboard motor 12 relative to the boat and/or any other outboard motors that may also be mounted to the boat, a rotational direction of the propeller of the outboard motor 12, a propeller shape, a trim tab angle, a trim tab shape, and the like.

Information on the installation number of the outboard motor 12, the installation position of the outboard motor 12 relative to the boat, the rotational direction of the propeller of the outboard motor 12, and the like are stored in the operation storage means 51. In this embodiment, such information is read and then transmitted to the outboard motor status recognition means 40 to thereby recognize the status of the outboard motor 12.

Thereafter, in step S15, the electric motor status detection means 41 detects a status of the electric motor 20. As used herein, the term "the status of the electric motor 20" refers to factors which influence the output characteristics of the electric motor 20, specifically a temperature and a voltage of the electric motor 20, the number of the electric motor 20 in operation, and the like. Other motor characteristics, such as maintenance status and the like, can be detected and/or stored by this detector 41.

The temperature of the electric motor 20 is detected by the temperature detection means 52. The number of the electric motor 20 in operation is detected by the operating number detection means 53. Detection signals from those means are transmitted to the electric motor status detection means 41 to thereby detect the status of the electric motor 20.

Based on such detection values, in step S16, the direction guide member deflection angle control means 42 in the ECU 33 computes a direction guide member deflection angle limit for direction guide member angle restriction, and in step S17, direction guide member deflection control is performed. The direction guide member deflection control is made such that the outboard motor 12 achieves the deflection limit angle as the ECU 33 controls the electric motor 20, and the process then returns to step S10.

As a result, during operation of the boat by the operator, since direction guide member deflection angle restriction is performed depending on a running status of the boat, and the like, the electric motor 20 is actuated within a range of advantageous motor performance and thus provides excellent responsiveness in substantially all conditions, and the operator can obtain an excellent feel of operation when deflecting the direction guide member.

In one preferred mode of operation, when a direction guide member deflection force required for direction guide member deflection is large and thereby a load to the direction guide member is large, or when the direction guide member is deflected in a direction which receives a reaction force to the propeller in response to a direction in which the steering wheel 17 has been operated, or a direction in which the direction guide member is expected to deflect, a direction guide member deflection angle limit is made smaller to limit the increase in the direction guide member deflection force.

Making the direction guide member deflection angle smaller corresponding reduces an increase in the direction guide member deflection force, allowing a much faster steering wheel operation. This also prevents exceeding the limit of direction guide member deflection ability during direction guide member deflection.

In some boat running status conditions, such as when the position of a waterline is high, the weight of the boat is heavy, or a trim angle is small so that the boat 12 is positioned in a certain fore-and-aft vertical range, a direction guide member deflection force corresponding to a direction guide member angle will increase.

In some embodiments in which such running status conditions are detected, making a direction guide member deflection angle smaller limits an increase in direction guide member deflection force, allowing a much faster operation of the steering wheel 17. This also prevents exceeding the limit of direction guide member deflection ability during direction guide member deflection.

In other boat running status conditions, such as when selectively accelerating or decelerating, the boat generates a propulsive force larger than that during cruising at a certain speed, which causes a reaction force to the propeller to increase.

When such conditions are detected in some embodiments, making the direction guide member deflection angle smaller limits an increase in the direction guide member deflection force, allowing a much faster steering wheel operation. This also prevents exceeding the limit of direction guide member deflection ability during direction guide member deflection.

Applicant has observed that a direction guide member deflection load can increase as the installation number of the outboard motor 12 increases. Also a direction guide member deflection load increases as the propeller increases in size. Further, a direction guide member deflection load also may increase in one direction depending on a rotational direction of the propeller. A direction guide member deflection load also can increase depending on the trim tab size. A direction guide member deflection load increases when a trim tab angle is deviating from a reference position corresponding to a boat speed, a trim angle, and a waterline.

In embodiments in which one or more of such conditions are detected, making the direction guide member deflection angle smaller limits an increase in the direction guide member deflection force, allowing a much faster steering wheel operation. This also prevents exceeding the limit of direction guide member deflection ability during direction guide member deflection.

As to the installation position of the outboard motor 12, in a boat with a plurality of the outboard motors 12, when it is driven with only part of the outboard motors 12 actually in operation, or when the individual outboard motors are in different trim status (when the lower part of the individual outboard motor 12 has a different underwater depth), direction guide member deflection load characteristics will not be the same between direction guide member deflection to the left and direction guide member deflection to the right. Accordingly, a propulsive force preferably is adjusted, depending on whether the outboard motor 12 generating the propulsive force is on the left or the right in the width direction of the boat, or the outboard motor 12 having a smaller trim angle and thereby a deeper underwater depth is on the left or the right in the width direction of the boat (the propulsive force is decreased when the direction guide member is returned from a deflected position to the side on which the outboard motor 12 of a deeper underwater depth is installed).

As the temperature of the electric water 20 for the steering device 16 rises, the motor characteristics described above tend to be exhibited as shown by broken line in FIG. 8, and thus less torque will be outputted from the motor. Accordingly, in one embodiment a direction guide member deflection angle limit is made smaller to thereby prevent exceeding the limit of the ability of the electric motor 20.

Also, the number of the electric motor 20 in operation preferably is detected, and for the fewer motors in operation, a direction guide member deflection angle limit is made smaller. More specifically, as the number of operable motors is fewer, a direction guide member deflection angle limit is made smaller to thereby prevent exceeding the functional ability of the electric motor 20. For example, in the case of a plurality of the electric motors 20 in use, if any of them is not operable due to a failure or the like; then the direction guide member deflection angle limit is reduced, In an embodiment in which a boat is equipped with a plurality of outboard motors 12 operatively coupled to each other for the same direction guide member deflecting movement, each outboard motor 12 having an electric motor 20, when part of the outboard motors 12 is inactivated and the associated electric motor 20 is also inactivated so that the direction guide member deflection is performed using the rest of the electric motors 20 the deflection angle limit is made smaller.

In the illustrated boat embodiments, the outboard motor 12 is deflected by the electric motor 20. Thus, it is advantageous that an operation feel of the steering wheel 17 can be lighter; however, in the case where the direction guide member is deflected to a great magnitude, a larger load is required when the direction guide member is returned to its original position than when the direction guide member was initially deflected. Accordingly, output from the electric motor 20 may become less responsive, resulting in a delayed response to a direction guide member deflecting operation. In a preferred embodiment, however, in accordance with the motor characteristics of the electric motor 20, a direction guide member deflection angle limit is made smaller to thereby prevent deflection angle limit deflecting the direction guide member to the extent that the electric motor is unable to return the direction guide member within an acceptable performance range.

As a result, the direction guide member deflection range preferably is limited, and thus the outboard motor 12 is deflected within the acceptable performance range of the output of the electric motor 20 even when the direction guide member is returned. This prevents a delayed response to a direction guide member deflecting operation.

More specifically, as shown in FIG. 6(*b*), as a running status or an electric motor status, such as a boat speed, a trim angle, the weight, an acceleration, a deceleration, or a propulsive force, increases, the relationship between direction guide member deflection angles and direction guide member deflection forces will change from the characteristics shown by solid line in FIG. 6(*b*) to the characteristics as shown in broken line in the figure. Accordingly, when a direction guide member deflection angle is the same as that in position "a1" of the characteristics shown in solid line, a direction guide member deflection force increases as that in position "a2" of the characteristics shown in broken line. When a direction guide member deflection force is the same as that in position "a1" of the characteristics shown in solid line, a direction guide member deflection angle decreases as that in position "a3" of the characteristics shown in broken line in order to maintain the same deflection force.

As a direction guide member deflection force or the like increases in this way, when a direction guide member deflection angle limit is large, the motor characteristics may fall outside of ability characteristic line C of the electric motor 20 at as position "b1" shown in characteristic line B1 in FIG. 6(*a*), which illustrates the relationship between direction guide member deflection forces and direction guide member deflection speeds. In such a case, when a direction guide member deflection angle limit is made smaller according to embodiments discussed herein, thereby changing the motor characteristics as shown by characteristic line B2, a direction guide member deflection force decreases as shown in position "b2" while the same direction guide member deflection speed as in position "b1" is maintained. As a result, the motor 20 characteristics falls within the range of ability characteristic line C. Accordingly, the outboard motor 12 can be deflected within the range of output of the electric motor 20, and thus no delayed response occurs during a direction guide member deflecting operation.

In some embodiments, the ECU 33 can include reaction motor control means 43 for controlling output of the reaction motor 29, so that when the direction guide member nearly achieves a direction guide member defection angle limit, output of the reaction motor 29 is increased based on a signal from the reaction motor control means 43 to increase a reaction force to the steering wheel 17.

This provides the operator a response corresponding to a direction guide member deflection load directly through the steering wheel 17, thereby preventing steering operating beyond a direction guide member deflection angle limit.

In the illustrated embodiments, the outboard motor 12 is used as the propulsion unit. It is to be understood that the present invention is not limited to this configuration, but may also or instead use an inboard-outdrive arrangement. Further, the foregoing embodiment includes the operation status detection means 38, the running status detection means 39, the outboard motor status recognition means 40 and the electric motor status detection means 41. However, acceptable embodiments may include only one, or more, of such detectors. Still further, the particular structure of the steering device and configuration of the steering motor has been employed to illustrate inventive principles. Such principles can still be employed with other steering structures and steering motor configurations.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A boat, comprising a hull, a propulsion unit at a stern of the hull, a steering device comprising a deflectable direction guide member and an electric actuator for deflecting the direction guide member so as to steer the boat, a steering wheel operable by an operator, the steering wheel adapted to provide an actuation signal corresponding to the amount of a steering wheel operation, a controller adapted to receive the steering wheel actuation signal and to direct the electric actuator to deflect the direction guide member, the controller configured to obtain or receive detection data concerning at least one of an operation status corresponding to the steering wheel operation, a running status of the boat, a status of the propulsion unit, and a status of the electric actuator, wherein the controller calculates a direction guide member deflection angle limit based on at least one of the detection data, the direction guide member deflection angle limit being calculated so that direction guide member deflection remains within a range in which the electric actuator maintains a threshold performance level so that steering performance remains advantageous.

2. The boat according to claim 1, comprising an operation status detector that detects at least one of a direction guide member deflection force required for direction guide member deflection, a load to the direction guide member, a direction in which the direction guide member is deflected corresponding to a direction in which the steering wheel is operated and/or the steering wheel operation, and a deviation of a detected actual direction guide member deflection angle from a target direction guide member deflection angle corresponding to the steering wheel operation.

3. The boat according to claim 2, comprising a running status detector that detects at least one of a position of a waterline and a weight of the boat, a trim angle of the boat, and at least one of a speed, an acceleration, a deceleration and a propulsive force of the boat, and an output of the propulsion unit.

4. The boat according to claim 3 additionally comprising an operation storage device for storing therein any one of pieces of information on the installation number of the boat propulsion unit, an installation position of the boat propulsion unit relative to the boat, a rotational direction of a propeller of the boat propulsion unit, a propeller shape, a trim tab angle and a trim tab shape.

5. The boat according to claim 4, comprising an electric actuator status detector that includes a temperature detector for detecting a temperature of the electric actuator.

6. The boat according to claim 5, wherein the electric actuator status detector includes an operating number detector for detecting the number of electric actuators in operation.

7. The boat according to claim 1, comprising a running status detector that detects at least one of a position of a waterline and a weight of the boat, a trim angle of the boat, and at least one of a speed, an acceleration, a deceleration and a propulsive force of the boat, and an output of the propulsion unit.

8. The boat according to claim 1 additionally comprising an operation storage device for storing information on one or more of the installation number of the boat propulsion unit, an installation position of the boat propulsion unit relative to the boat, a rotational direction of a propeller of the boat propulsion unit, a propeller shape, a trim tab angle and a trim tab shape.

9. The boat according to claim 1, comprising an electric actuator status detector that includes a temperature detector for detecting a temperature of the electric actuator.

10. The boat according to claim 9, wherein the electric actuator status detector includes an operating number detector for detecting the number of electric actuators in operation.

11. The boat according to claim 10 additionally comprising a reaction motor for applying a reaction force to the steering wheel, and a reaction motor controller, wherein the reaction motor controller is adapted to increase a reaction force of the reaction motor as the direction guide member approaches the direction guide member deflection angle limit.

12. The boat according to claim 1, comprising an electric actuator status detector that includes an operating number detector for detecting the number of electric actuators in operation.

13. The boat according to claim 1 additionally comprising a reaction motor for applying a reaction force to the steering wheel, and a reaction motor controller, wherein the reaction motor controller is adapted to increase a reaction force of the reaction motor as the direction guide member approaches the direction guide member deflection angle limit.

14. The boat according to claim 1, wherein the propulsion unit comprises an outboard motor, and wherein the direction guide member is part of the outboard motor.

15. A method of steering a boat having a propulsion unit supported by a hull, a direction guide member, and an electric actuator adapted to deflect the direction guide member to effect steering, the method comprising providing a controller adapted to control deflection of the direction guide member, providing a steering wheel adapted to generate a signal corresponding to steering wheel operation, communicating the steering wheel signal to the controller, communicating to the controller detection data concerning at least one of an operation status corresponding to steering wheel operation, a running status of the boat, a status of the propulsion unit, and a status of the electric actuator, and calculating a direction guide member deflection angle limit based on at least one of the detection data communicated to the controller, wherein the direction guide member deflection angle limit is calculated so that the electric actuator will be capable of deflecting the direction guide member up to the direction guide member deflection angle limit while maintaining a desired range of performance.

16. The method of claim 15 additionally comprising providing a reaction motor for applying a reaction force to the steering wheel, the reaction motor being controllable by the controlling, and increasing the reaction force exerted by the reaction motor as the direction guide member approaches the direction guide member deflection angle limit.

* * * * *